US006745677B2

(12) United States Patent
Pearson et al.

(10) Patent No.: US 6,745,677 B2
(45) Date of Patent: Jun. 8, 2004

(54) STRAPPING MACHINE WITH EASY ACCESS AND FEED GUIDES

(75) Inventors: Timothy B. Pearson, Antioch, IL (US); Ronald W. Gurak, Oakwood Hills, IL (US); Jonathan Lopez, Vernon Hills, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/966,473

(22) Filed: Sep. 28, 2001

(65) Prior Publication Data

US 2003/0010225 A1 Jan. 16, 2003

Related U.S. Application Data

(60) Provisional application No. 60/304,913, filed on Jul. 12, 2001.

(51) Int. Cl.[7] ..... B65B 13/04
(52) U.S. Cl. ..... 100/26; 100/29; 53/589
(58) Field of Search ..... 100/4, 26, 29, 100/32, 33 PB; 53/589; 156/494

(56) References Cited

U.S. PATENT DOCUMENTS

| | | | | | |
|---|---|---|---|---|---|
| 3,759,169 | A | * | 9/1973 | Goodley | 100/29 |
| 3,768,396 | A | | 10/1973 | Coleman | 100/26 |
| 3,913,472 | A | * | 10/1975 | Buck | 100/4 |
| 4,011,808 | A | | 3/1977 | Aoki et al. | 100/26 |
| 4,050,372 | A | * | 9/1977 | Kobiella | 100/2 |
| 4,155,799 | A | * | 5/1979 | Matsushita et al. | 156/494 |
| 4,520,720 | A | | 6/1985 | Urban et al. | 100/26 |
| 4,711,071 | A | | 12/1987 | Kägi | 53/589 |
| 5,287,802 | A | * | 2/1994 | Pearson | 100/4 |
| 5,640,899 | A | * | 6/1997 | Bell et al. | 100/2 |
| 5,823,103 | A | | 10/1998 | Kuei | 100/4 |
| 6,415,712 | B1 | * | 7/2002 | Helland et al. | 100/26 |
| 6,478,065 | B1 | * | 11/2002 | Haberstroh et al. | 156/443 |

* cited by examiner

*Primary Examiner*—Allen Ostrager
*Assistant Examiner*—Jimmy Nguyen
(74) *Attorney, Agent, or Firm*—Mark W. Croll, Esq.; Donald J. Broh, Esq.; Welsh & Katz, Ltd.

(57) ABSTRACT

A strapping machine for positioning a strapping material around an associated load and sealing the strapping material to itself around the load includes a frame, a chute mounted to the frame for conveying the strapping material around the load, a feed assembly mounted to the frame for feeding the strapping material, a guide configured to transfer the strapping material from the feed assembly and a strapping head. The head is configured to receive the strapping material from the feed assembly via the guide during a feed mode. The strapping head includes a body and defines a first conveyance path for the strapping material from the guide to the chute, and a second conveyance path to receive a free end of the strapping material to seal the strapping material to itself. The second conveyance path is defined by a plurality of surfaces in the body that define a substantially constant width path through the second conveyance path. The machine includes a transfer guide mounted to the frame between the feed assembly and the strapping head and a feed guide including a cover for covering at least a portion of the feed assembly. The transfer guide has a fixed portion and a removable cover portion. The feed guide cover portion includes an arcuate guide wall transverse to the cover generally parallel to the strapping material feed plane.

10 Claims, 7 Drawing Sheets

STRAPPING MACHINE WITH EASY ACCESS AND FEED GUIDES

BACKGROUND OF THE INVENTION

Strapping machines are in widespread use for securing straps around loads. There are two principle types of strappers. One type is a manually operated hand tool that can be used, for example, around a job site. Another type of strapper is a stationary arrangement in which the strapper is fabricated as part of an overall apparatus. In such a strapper, the strapping head and drive mechanisms are typically mounted within a frame. A chute is likewise mounted to the frame, through which the strapping material is fed.

In a typical, stationary strapper, the strapping head is mounted at about a work surface, and the chute is positioned above the work surface and above the strapping head. Strap material is fed to the strapping head by a set of feed and take-up wheels. The strapping material is fed, by the feed wheels past the strapping head, around the chute and back to the strapping head. The free end of the strapping material is then grasped, such as by a first part of a gripping arrangement. The strap is then retracted by the take-up wheels and tensioned around the load. The tensioned strap is then gripped by a second part of the gripping arrangement. A cutter in the strapping head then cuts the tensioned strap (from the source or supply) and the strapping head forms a seal in the strapping material, sealing the strapping material to itself around the bundled load.

Strapping operations are typically secondary operations in that these operations are used for bundling or securing individual items into a single, large load. The straps themselves are not of commercial concern to the end user; rather, it is the bundled items that are of concern. As such, it is important to be able to strap and move the items quickly and in a cost effective manner.

To this end, improvements have been made to strapping machines. One such improvement includes an auto re-feed arrangement, such as that disclosed in Bell, et al., U.S. Pat. No. 5,640,899, commonly assigned herewith. In such an arrangement, in the event of a misfeed of strapping material, the misfed strap is cut and ejected from the machine. Fresh strapping material is then automatically re-fed by the feed wheels through the strapping head and around the load. It has been found that such an arrangement saves considerable time and labor vis-à-vis removing the misted or snapped strap and refeeding strap material into the strapper.

One drawback to the known re-feed arrangements is that they require separate feed and take-up wheels. That is, a pair of wheels (generally one driven and one idle) is required to feed the strapping material through the strapping head and the chute. A second, separate set of wheels (again, one driven and one idle) is required to take-up or retract the strap in order to tension the strap around the load. While these automatic re-feed arrangements have been found to save considerable time and labor, the requisite two pairs of wheels introduce additional maintenance concerns as well as timing arrangements with respect to the overall operation of the machine.

It has also been found that typically, these stationary types of strappers are designed and constructed such that the feed and take-up mechanism is located near to the strapping head. Because of the proximity of the feed and take-up arrangement to the strapping head, two sets of feed and take-up wheels are required in order to meet the overall operating requirements, given the physical constraints of the equipment.

Present designs of stationary strappers, which include a closely located feed and take-up mechanism to the strapping head, also include guide paths to, from and between components that are all fixedly mounted to the machine. In the event of maintenance or repair, the machine must be taken out of service for the duration of that work. In addition, skilled technicians are generally required to tend to the machine during the entirety of the maintenance or repair procedure.

It has further been observed that the guides of known strappers, that is those portions of the strapper along which the strap material is guided while it is fed around the strap path tend to clog with debris from the strapping material. This debris can either be residue from the plastic strapping material itself, or debris that is carried by the strapping material into the machine. Typically, these guides have very small clearances between the guides themselves and between the guides and the active (driven or idle, rotating) machine components. As a result, it is necessary, at times, to shut down the machine, open the guide paths and clear these guide paths of debris. Known machines typically require disassembly of those portions of the machine which, again, requires significant labor and time. In addition, strappers are known to occasionally jam, in which strap material may get caught at about the active machine components or between the active and stationary machine components. In order to clear or remove these jams, again, the guide paths require disassembly necessitating time and labor.

Another concern with known strapping machines is that at times, the strap is not aligned with itself prior to forming the seal or "weld". In order to achieve maximum tension strength in the strap joint the strap should be fully aligned with an adjacent layer of strap prior to welding. This maximizes the area over which the weld is performed. Known strappers rely upon an alignment of stationary strap guides or paths in order to properly position the strap material in this aligned, adjacent arrangement. However, at times, the strap shifts as it is aligned or prior to welding, resulting in misaligned straps and less than optimal joint strength.

Accordingly, there exists a need for a strapping machine that utilizes modular components, specifically for the drive and sealing functions. Desirably, such modular components are readily removed and installed in machines to minimize the "down time" of such machines. Most desirably, such modular components are readily installed and removed, with minimal or no tools. Further, a need exists for a strapper that minimizes clogging and provides easy access to the guide areas. Again, most desirably, access is provided to these areas with minimal or no tools. Still more desirably, the guide pathway and covering therefor are formed as integral units further minimizing disassembly to clear these paths. In such a strapper, an auto re-feed arrangement is desirable without the use of separate feed and take-up wheels. A need further exist for a strapper in which strap alignment, prior to welding, is actively provided.

BRIEF SUMMARY OF THE INVENTION

A strapping machine positioning a strapping material around an associated load and seals the strapping material to itself around the load. The strapping machine includes a frame, a chute defining a strap path mounted to the frame, a modular feed assembly mounted to the frame, a guide mounted to the frame adjacent the feed assembly, and a modular strapping head mounted to the frame independent of the feed assembly and the guide.

The feed assembly is configured to feed the strapping material from a source to the guide. The guide is mounted to the frame independent of the feed assembly and the strapping head. The guide is configured to receive the strapping material from the feed assembly and to provide a path for the strapping material toward the strapping head.

The strapping head includes a body and provides a conveyance path for the strapping material to the chute. In one embodiment, the strapping head defines a first conveyance path for the strapping material from the guide to the chute, and a second conveyance path to receive a free end of the strapping material to seal the strapping material to itself.

Preferably, the strapping head includes an anvil movably mounted to the body and forming a part of the second conveyance path. The anvil is movable between a first conveying position in which the anvil is pivoted away from the body to enlarge the second conveyance path and a second sealing position in which the anvil is pivoted toward the body to narrow the second conveyance path.

The anvil can be pivotally movable toward and away from the body. Preferably, the anvil is biased toward the body. In this arrangement, strapping head includes a side plate pivotally mounted to the body. The anvil is fixedly mounted to the side plate. The strapping head can include a cam for moving the anvil between the first conveying position and the second sealing position. The cam cooperates with the side plate to pivot the anvil.

The present strapping machine further contemplates an embodiment in which a controller controls the operation of the strapping machine. The controller is operably connected to the feed assembly.

A sensor is disposed to sense the presence and absence of strapping material at the strapping head. The sensor includes first and second movable elements, preferably paddles, that cooperate with one another. The paddles are movable between a first position in which the sensor senses the presence of strapping material and a second position in which the sensor senses the absence of strapping material. The sensor is operably connected to the controller and when the sensor senses the absence of strapping material at the strapping head, a control signal is generated to initiate operation of the feed assembly in a refeed mode.

In a current embodiment, the sensor is mounted to the strapping head at about a strap exit path of the strapping material from the strapping head. Preferably, the paddles pivot about a common pivot pin. The strapping material engages the first paddle to pivot the paddles between the first and second positions.

The sensor can include a proximity sensor cooperating with the first and second paddles. The second paddle is positioned between the proximity sensor and the first paddle being. The first paddle is biased toward the proximity sensor and the second paddle is biased away from the first paddle. First and second biasing elements bias the first paddle toward the proximity sensor and the second paddle away from the first paddle, respectively.

A hinge stop limits travel of the first and second paddles away from one another. The second paddle operably contacts the proximity sensor during the feed mode and the take-up mode, and the second paddle is operably separated from the proximity sensor during a refeed mode.

A preferred strapping head includes a second conveyance path to receive a free end of the strapping material to seal the strapping material to itself. The second conveyance path is defined by a plurality of surfaces within the body. The surfaces define a substantially constant width path through the second conveyance path.

An entryway precedes the second conveyance path. The entryway has a larger path width than the conveyance path width. A gripper is disposed at a terminal end of the conveyance path.

The strapping machine further contemplates an easy access transfer guide mounted to the frame between the feed assembly and the strapping head. The transfer guide includes a fixed portion and a cover portion. The fixed portion is fixedly mounted to the frame independent of the feed assembly and the strapping head. The transfer guide is configured to receive the strapping material from the feed assembly and to provide a path for the strapping material toward the strapping head. The cover portion overlies the fixed portion along a plane that is substantially parallel to the a plane defined by a longitudinal axis and a width of the strapping material.

In a preferred arrangement, the cover portion is pivotally mounted to the fixed portion by hinges and is retained in place covering the fixed portion by at least one, and preferably multiple mechanical fasteners. Most preferably, the mechanical fasteners are knurled to permit tool-less loosening. In a current embodiment, fasteners include a hinge-supported portion, so that when the fasteners are loosened from the cover portion (e.g., pivoted away from the cover portion) the hinge-supported portions retain the fasteners mounted to the fixed portion.

The strapping machine can further include an easy access feed guide for covering at least a portion of the feed assembly. The feed guide includes a cover for covering at least a portion of the feed assembly and an arcuate guide wall transverse to the cover. The guide portion is generally parallel to the strapping material as is traverses through the guide. The guide wall is spaced from a periphery of one of the feed wheels at about an entry of the strapping material into the feed guide and converges toward a periphery of the one of the feed wheels as the guide wall approaches the nip of the feed wheels.

The cover portion is removably mounted to the fixed portion by mechanical fasteners. Preferably, the fasteners are knurled to permit tool-less loosening. Most preferably, hinge-supported fasteners are used to mount the cover to the feed guide. This permits the cover portion to be readily removed for quick cleaning.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figures 1, 2:
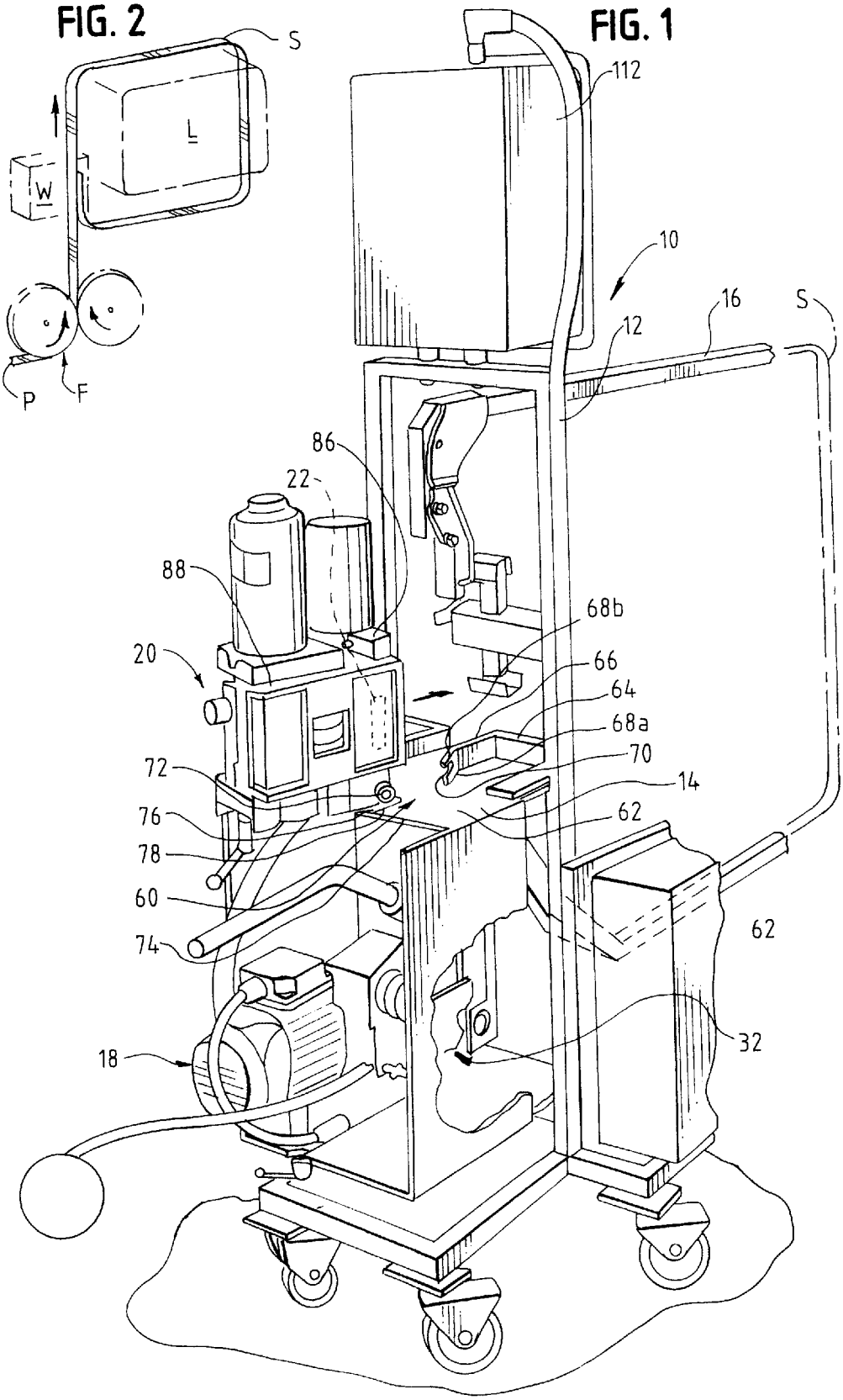
FIG. 1 is a perspective view of an improved modular strapping machine in accordance with the principles of the present invention, the strapping machine being illustrated with the strapping head partially removed from the frame, and a portion of the frame missing at about the feeding assembly, for clarity of illustration.
FIG. 2 is a schematic illustration of the strapping machine function, illustrating the strap being fed around a load.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular, to FIG. 1, there is shown a strapping machine or strapper 10 embodying the principles of the present invention. The strapper 10 includes a frame 12 having a work surface or top 14 mounted thereto. The frame 12 defines a chute or strap path 16 about which the strap S is conveyed during a strapping operation. A strap supply P provides the strap material S for the strapper 10.

The strap S is fed from the supply P into the strapper 10 by a feed arrangement 18. The strap S is conveyed by the feed arrangement 18, through a strapping head 20 into the chute 16. The strap material S traverses through the chute 16, and returns to the strapping head 20. The free end (that is the first fed end of the strap S) is, upon return to the strapping head 20, gripped by a first gripping portion 22*a* of a gripper 22 in the strapping head 20. The feed mechanism 18 then reverses to provide tension in the strap S. When a desired tension is achieved, the strap S is gripped by a second portion 22*b* of the gripper 22. The strap S is then cut to separate the strap S from the source P. The strap S is then welded or otherwise sealed onto itself. The load L is then removed from inside the chute 16 region or strap path and a new load is positioned therein for strapping.

Figure 3:
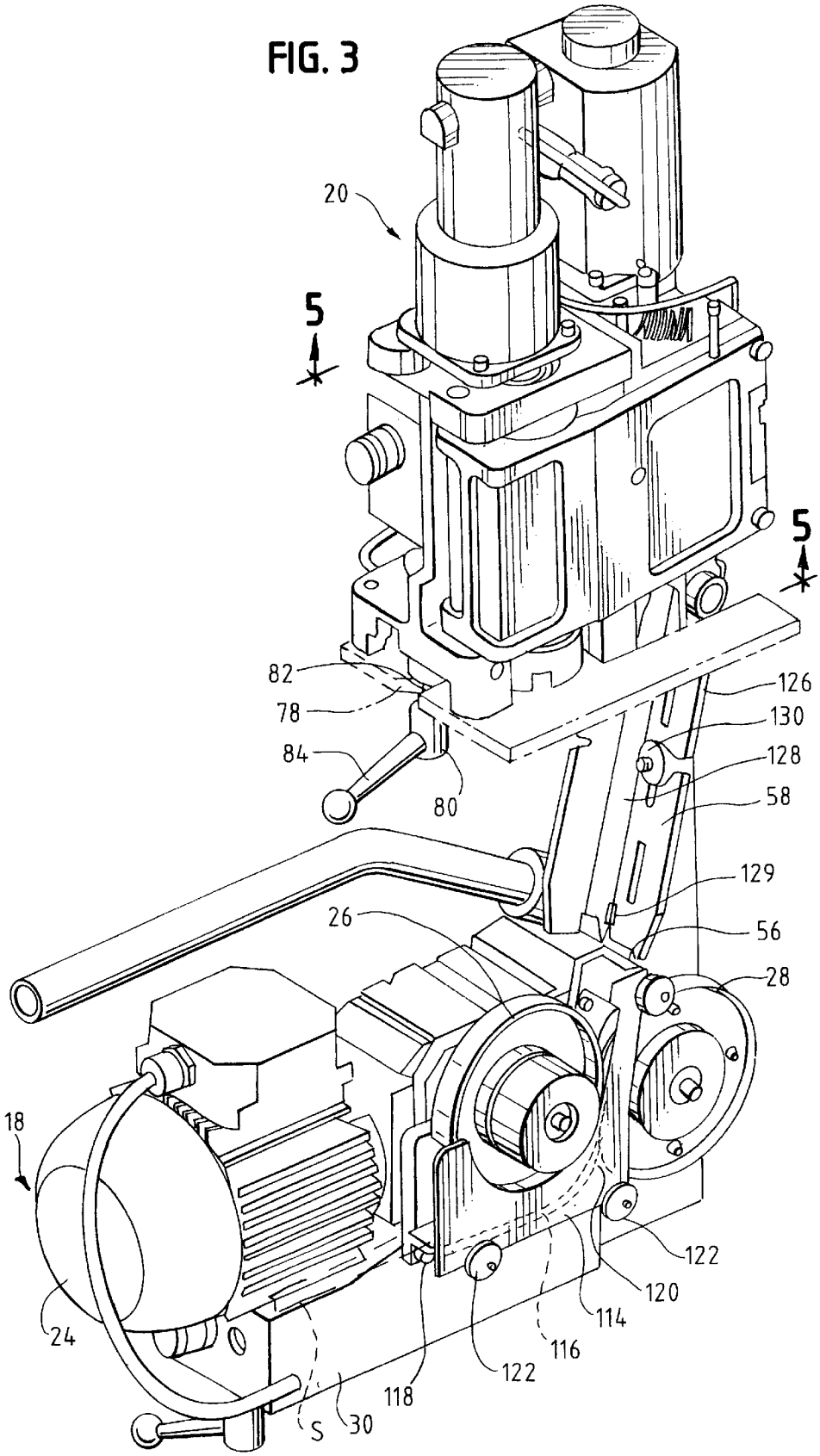
FIG. 3 is a partial perspective view of the modular strapping machine feed assembly and strapping head removed from the frame for clarity of illustration.

Unlike known strappers, the present strapper 10 includes a modular arrangement in which the feed assembly 18 and strapping head 20 are removably mounted to the frame 12. That is, the feed arrangement 18, which includes generally a motor 24, and a pair of feed wheels 26, 28, is mounted to a base 30 that is in turn mounted to the frame 12. Referring to FIG. 3, there is shown an exemplary feed assembly 18 illustrating the motor 24, a driven wheel 26 and an idler wheel 28. The idler wheel 28 is mounted for free rotation with the driven wheel 26 when the strap material S is between the driven wheel 26 and the idler wheel 28 and the motor 24 is actuated.

Figure 4:
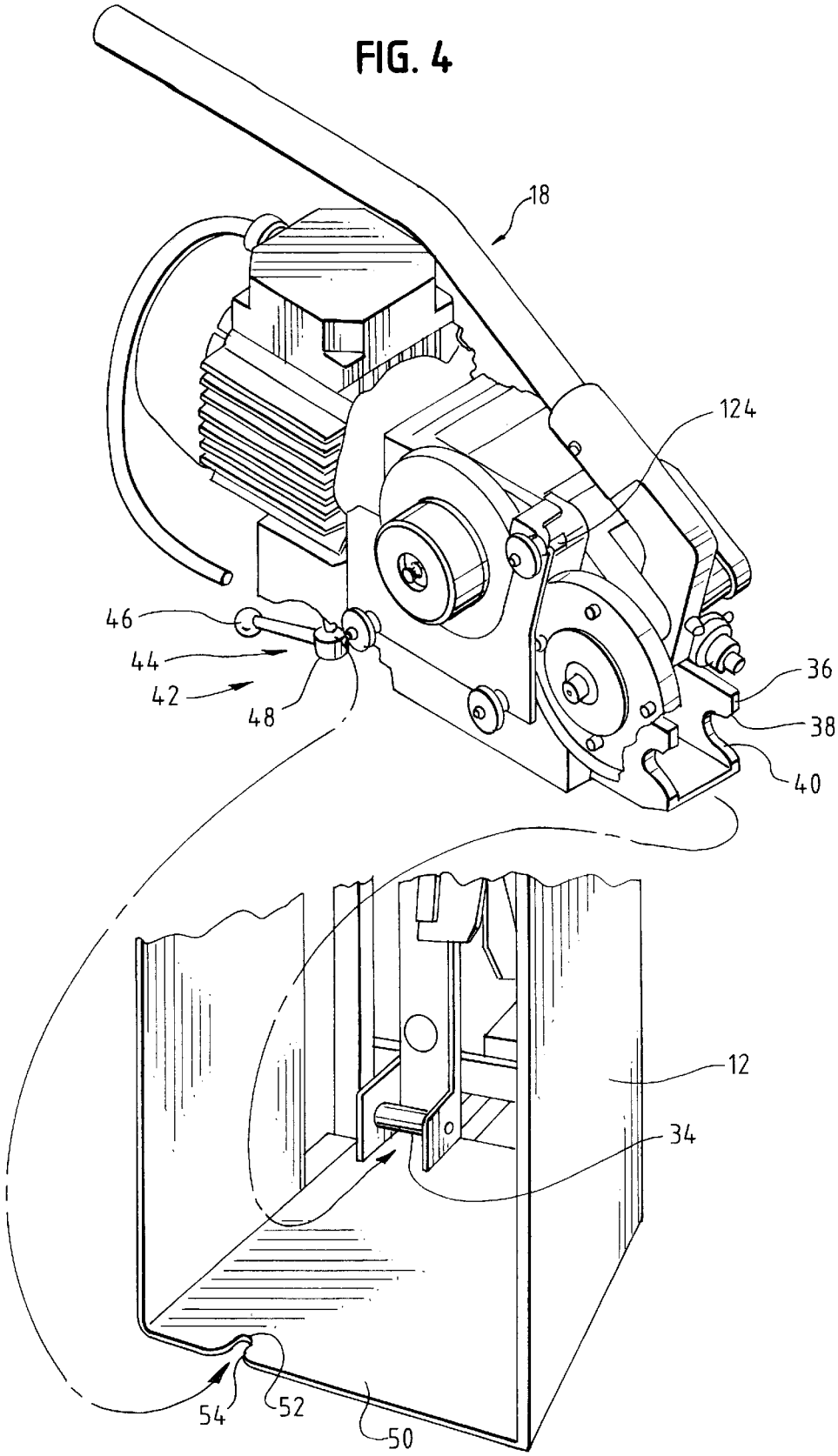
FIG. 4 is a partial perspective view of the feed assembly and the frame portion in which it is mounted.

To assure that the feed assembly 18 is properly mounted within the frame 12, the feed assembly 18 and frame 12 include portions of a cooperating aligning and mounting assembly 32. In one such arrangement, as shown in FIGS. 1 and 4, the frame 12 includes a 34 nesting member configured as a transverse beam element. The feed assembly 18 includes a complementary, cooperating receiving member 36 that aligns with the transverse beam 34. In a current embodiment, the receiving member 36 is formed as a generally channel shaped aligning head 38 having a pair of slots or rounded notches 40 formed therein complementary to the beam 34. The feed assembly 18 is positioned in the frame 12 such that the notches 40 are fitted onto the beam 34. This aligns the feed assembly 18 in the frame 12.

At a rear end 42 of the feed assembly 18, the aligning and mounting assembly 32 includes a clamp 44. The clamp 44 can be formed, for example, as a handle 46 that is mounted to a threaded stud 48. The frame 12 can include a base portion 50 having a notch 52 formed therein. The notch 52 has an enlarged or V-shaped opening 54 to readily permit aligning the stud 48 in the notch 52. As the feed assembly 18 is positioned on the frame 12, the aligning notches 40 are positioned immediately forward of the beam 34 and the stud 48 is positioned in the open end 54 of the V-opening. The feed assembly 18 is then urged forward until the notches 40 are positioned on the beam 34 and the stud 48 is positioned in the base notch 52. The handle 46 is then rotated to clamp the feed assembly 18 securely in place on the frame 12. In this manner, a discharge area 56 of the feed assembly 18 (as illustrated in FIG. 3) is properly aligned with a strap guide (the transfer guide 58) or strap guide for transport of the strapping material S to the strapping head 20.

The strapping head 20 is mounted to the frame 12 in a similar manner. To this end, the strapping head 20 and the frame 12 include portions of a cooperating aligning and clamping assembly 60. The frame 12 includes an upper base or shelf 62 having a transverse, forward lip 64. The lip 64 has an opening 66 therein for receiving the strapping head 20. The opening 66 is formed by a pair of walls 68*a,b* having aligning slots or notches 70 formed therein.

The strapping head 20 includes an aligning or nesting member 72 that, when the head 20 is moved forwardly in the frame 12, resides in the aligning slots 70. In a present embodiment, the aligning member 72 is formed as a beam or like member, and the aligning slots 70 in the walls 68*a,b* receive the beam 72. A rear end 74 of the shelf 62 includes a notched opening 76 having an enlarged or V-shaped entrance 78. The strapping head 20 includes a clamp 80 such as the exemplary threaded stud 82, and a handle 84 for threading the stud 82. As with the feed assembly 18, when the strapping head assembly 20 is urged forward, the beam 72 is urged into the slots 70 as the stud 82 is urged into the clamping notch 76. Once the strapping head 20 is properly positioned, the handle 84 is rotated to clamp the strapping head 20 in place on the frame 12.

The present arrangement has a number of advantages over known strappers. First, the modular, tool-less arrangement permits readily changing out either the strapping head 20 or the feed assembly 18. As such, as maintenance or repair is required on either the strapping head 20 or the feed assembly 18, that portion of the strapper 10 can be removed and a spare inserted in its place. In this manner, the operational "down-time" of the machine 10 is minimized. That is, the strapping head 20 or feed assembly 18 can be removed and a spare installed in, perhaps less than a minute. That portion of the strapper 10 requiring maintenance or repair (e.g., the feed assembly 18 or strapping head 20) can then be removed and taken away, for example, to a maintenance shop, where the necessary work can be carried out, away from the strapping machine 10 and other operations.

Another advantage provided by the present strapper 10 is that it establishes a distance between the feed assembly 18 and the strapping head 20. Those skilled in the art will recognized that, at times, strapping material becomes jammed or are misfed into the strapper 10. When this occurs, it is most desirable to have a strapper 10 having an auto eject and re-feed arrangement. In such an arrangement, the misfed strap is automatically ejected from the strapper and the strap feed is automatically restarted to place the strapper 10 back into operation. Thus, operator time and attention is minimized by automatically ejecting the misfed strap and automatically refeeding from the strap supply. An exemplary auto refeed arrangement is illustrated in the aforementioned Bell, et al., U.S. Pat. No. 5,640,899.

One drawback to known auto refeed arrangements is that there must be a sufficient distance between the feed wheels and the strapping head to prevent the strap material from being ejected beyond the feed wheels (by the take-up or tension wheels). This is of particular concern in that the machines operate at relatively high speeds and the detecting instruments and control system have certain reaction time constraints. That is, because the strap is conveyed so quickly through the machine, after a misfeed is detected, the strap can be ejected from the machine by the take-up wheels beyond the feed wheels, thus defeating the auto-refeed function. In other words, if there is insufficient distance between the strapping head (which is the location of the misfeed detector) and the feed wheels, the take-up wheels will eject the strap beyond the feed wheels. As such, there will not be fresh strap material to be fed through the feed wheels to the strapping head.

The present arrangement provides the necessary distance between a strap misfeed detector 86 (mounted on the strapping head 20) and the feed wheels 26, 28. As such, only a single set of wheels (e.g., the pair of wheels 26, 28) is required for both the feed and retraction functions. In this manner, when a misfeed is detected, the feed wheels reverse to eject the misfed strap from the strapping head 20. When the jammed or misfed strap is cleared, there is sufficient distance between the detector 86 and the feed wheels 26, 28 for the feed wheels 26, 28 to be stopped (from the reverse direction) and returned to the forward feeding direction.

Referring now to FIGS. 3 and 7–10, the strap detector 86 assembly cooperates with the feed assembly 18, that is the feed wheels 26, 28, to stop forward movement of the strap material S when a misfeed is detected, reverse the wheels 26, 28 to eject misfed strap, and subsequently reinitiate forward movement (refeed) of the strap material S after the misfed strap is ejected. The misfeed detector 86 is mounted at about the top 88 of the strapping head 20 and includes a proximity sensor 90 and first and second biased elements 92, 94, respectively. In a present embodiment, the biased elements 92, 94 are first and second paddles that are biasedly mounted to a base 96 at a detecting end of the proximity sensor 90. The paddles 92, 94 are hingedly or pivotally mounted to the base 96 by a common pivot pin 98.

The paddles 92, 94 are mounted such that the second paddle 94 is positioned between the first paddle 92 and the base 96. A biasing element 100, such the exemplary first spring biases the first paddle 92 away from the base 96 and the proximity sensor 90. A second biasing element 102, such as the exemplary second spring biases the second paddle 94 away from the first paddle 92. In this manner, in order to maintain the second paddle 94 in contact with the proximity sensor 90, a force must be exerted on the paddles 92, 94 against the force of the first spring 100.

Figure 9:
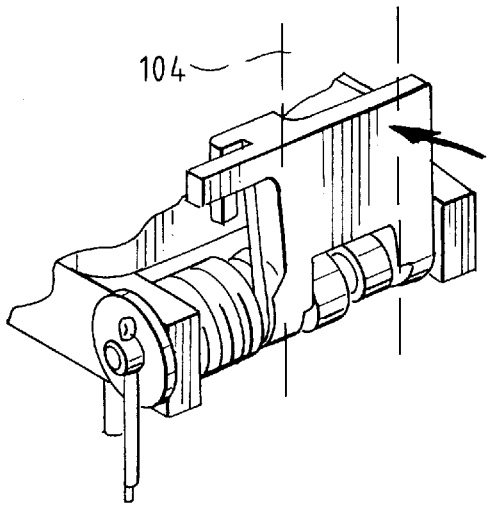
FIG. 9 is a perspective view of the sensor when the strapping machine is in the strapping mode.
Figure 10:
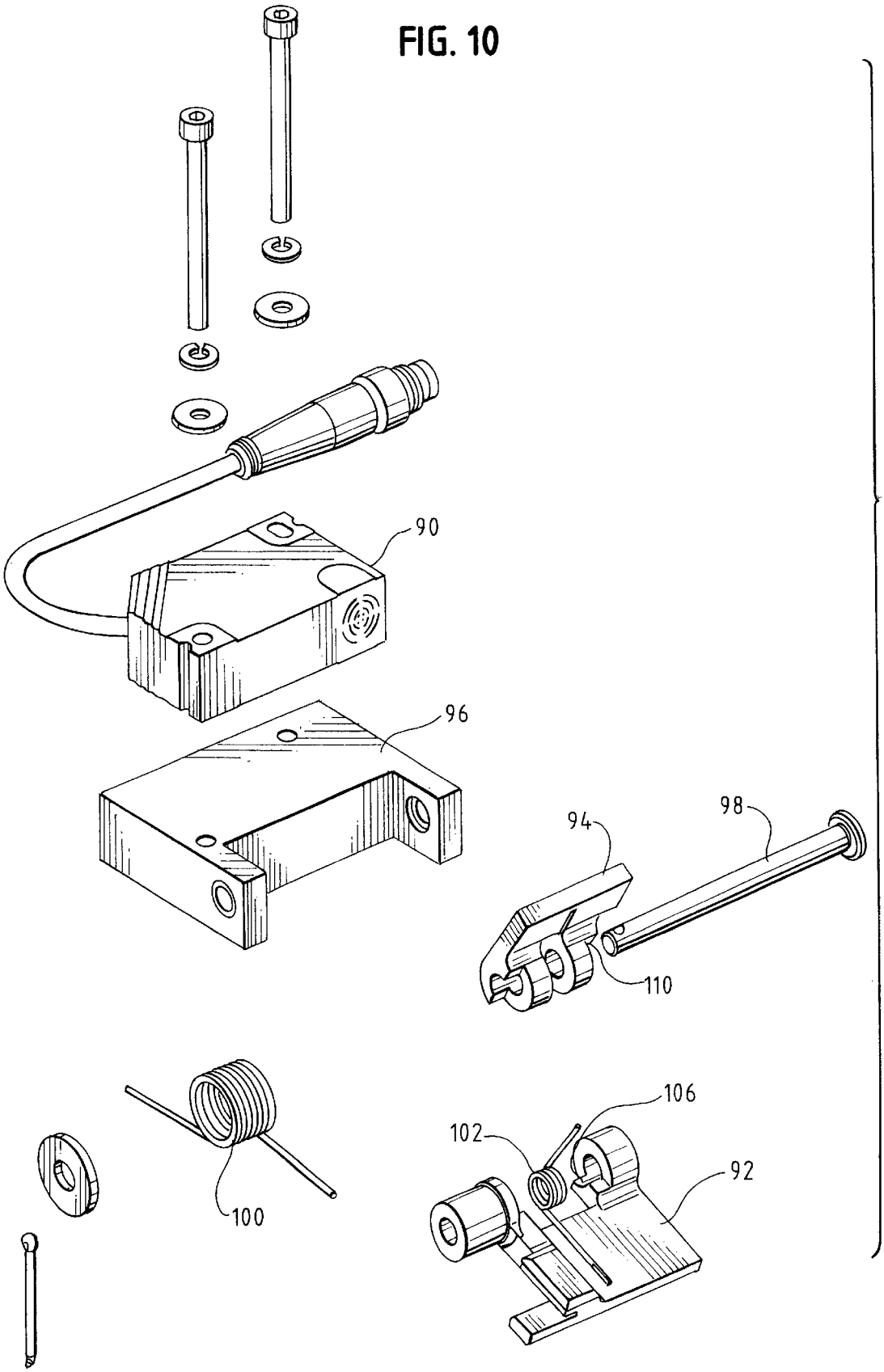
FIG. 10 is an exploded view of the sensor.

The paddles 92, 94 are positioned to lie across the strap path as indicated at 104, e.g., on the top of the strapping head path, when there is no force exerted against the first spring 100. Conversely, when a strap S is in the strap path 104, and the paddles 92, 94 are in the feed position (as seen in FIG. 9), first paddle 92 is urged against its spring 100 force, toward the proximity sensor 90. The second paddle 94 is operably connected to the first paddle 92 such that any force exerted on the first paddle 92 urges the second paddle 94 into contact with the proximity sensor 90. Although the second paddle 94 is biased away from the first paddle 92, the spring force of the first spring 100 is greater than the spring force of the second spring 102. As such, the first paddle 92 forces the second paddle 94, against the spring force of the second spring 102, into contact with the proximity sensor 90.

Figure 8:
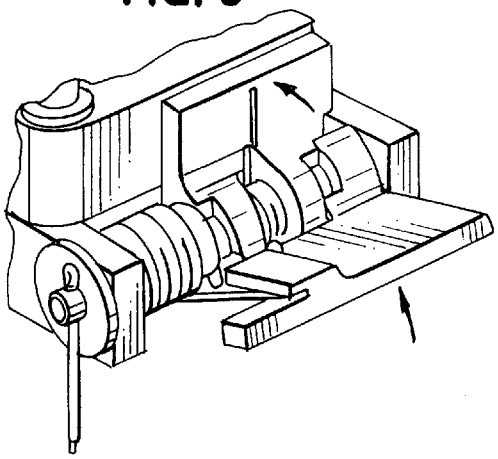
FIG. 8 is a perspective view of the sensor when the strapping machine is operating in the retraction mode.

In the take-up position, as illustrated in FIG. 8, there is sufficient slack (or lack of tension) in the strap S to permit the first paddle 92 to "drop". However, because some tension remains in the strap S, the first paddle 92 does not "drop" fully to rest on the top 88 of the strapping head 20. Thus, even though the first paddle 92 has moved down (but not fully dropped) the spring force of the second spring 102 maintains the second paddle 94 in contact with the proximity sensor 90.

Figure 7:
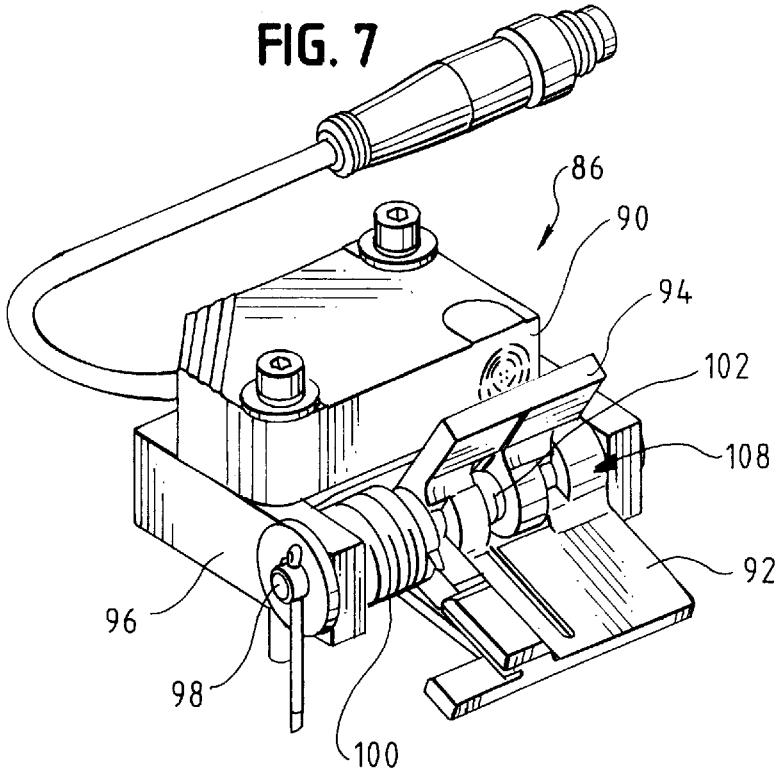
FIG. 7 is a perspective view of a strap sensor embodying the principles of the present invention, the sensor being shown when in strapping machine is operating in the refeed mode.

Referring now to FIG. 7, the paddles 92, 94 are shown in the refeed position, in which the strap S is fully full missing from the strapping head path 104. In this position, the first paddle 92 fully "drops" to rest on the top 88 of the strapping head 20, as urged by the force of the first spring 100. Even though the force of the second spring 102 urges the second paddle 94 away from the first paddle 92 (upward, toward the proximity sensor 90), a hinge stop 106 on the first paddle 92 at the hinge region 108 (best seen in FIG. 10) contacts a flat 110 on the second paddle 94 at the hinge region 108, thus preventing further separation of the paddles 92, 94 from one another. In this arrangement, contact of the hinge stop 106 with the flat 110 prevents the paddles 92, 94 from separating from one another beyond an angle of about 45°. In this manner, when the strap S is fully missing from the strapping head path 104, because the spring force of the first spring 100 is greater than the spring force of the second spring 102, and due to the engagement of the hinge stop 106 with the flat 110, the second paddle 94 is pulled from contact with the proximity sensor 90. This initiates a refeed sequence in the strapping machine controller 112.

This dual paddle 92, 94 arrangement provides for continued contact of the second paddle 94 with the proximity sensor 90 when the strapper 10 is in the feed mode, and the take-up or retraction mode. As will be recognized by those skilled in the art, when there is a reduced tension on the strap material S, the first paddle 92 may move away from the second paddle 94, however, it will not move so far as to permit the second paddle 94 to disengage from or lose contact with the proximity sensor 90. Also as will be recognized by those skilled in the art, when there is a misfeed of strap S, when the seal or weld fails, or when the strap S breaks, the first paddle 92 will move fully away from the proximity sensor 90, allowing the second paddle 94 to break contact with the sensor 90.

When the detector 86 detects a misfed strap S (i.e., when the second paddle 94 breaks contact with the sensor 90), the strapper S may be controlled such that the strapper 10 automatically operates in an ejection mode, in which any strap S remaining within the strapping head 20 is ejected therefrom. Following ejection, the auto refeed sequence can start in which strap material S is automatically refed by the feed wheels 26, 28 up to the strapping head 20. Detector arrangements other than that illustrated will be recognized by those skilled in the art and are within the scope of the present invention.

Referring now to FIG. 3, the present strapper 10 includes multiple easy access guides 58, 114. As their references suggest, these guides 58, 114 provide ready access to the strap path in order to, for example, clean debris and/or clogs from the path. Unlike known strappers, the guides 58, 114 are formed as part of removable sections of the strapper 10. That is, while in known strappers, doors provide access to a fixed guide, the present guides 58, 114 are formed as part of the removable portions of the machine 10. As seen in FIG. 3, a feed guide 114 is formed as part of the removable section covering the feed wheels 26, 28.

The feed guide 114 includes a curved or arcuate guide portion 116 (shown in phantom lines) that extends from an entryway 118 below the feed wheel motor or drive 24 to about a nip 120 of the wheels 26, 28. At the entryway 118, the guide portion 116 is spaced from a periphery of the driven wheel 26. Traversing along the arc of the guide 114 toward the nip 120, the guide portion 116 approaches the periphery of the driven wheel 26. Referring to FIG. 3, it can be seen that the strapping material S enters the feed guide 114, traversing below the feed drive 24. The strapping material S is guided by the guide portion 116 into the nip 120 for feeding to the strapping head 120.

In a current embodiment, the guide 114 is retained in place on the feed assembly 20 (covering at least a portion of the feed wheels 26, 28) by a plurality of threaded fasteners 122, illustrative of which are the three fasteners shown. The fasteners 122 are preferably knurled to permit installation and removal without the use of tools, e.g., by hand. The fasteners 122 can be supported on hinged or pivoting supports 124 that, once loosened, permit pivoting the fasteners 122 away from the guide 114 to permit removal. In this manner, the fasteners 122 are maintained affixed to the feed assembly 18, thus preventing inadvertently misplacing the fasteners 122.

As will be appreciated from the figures, because the guide 114 itself includes that surface 116 on which the strapping material S travels during operation, the guide 114 can be readily removed from the feed assembly 18, and the surface 116 cleaned of debris. The guide 114 can then be readily replaced on the feed assembly 18. Again, this is unlike known guides which are fixed in place and are only accessible by pivoting door or access panel. In that, as set forth above, the tolerances are rather small and the spaces rather narrow through the strap path, the present easy access feed guide 114 provides numerous, readily appreciated advantages over the prior known guide access arrangements.

A bridging or transfer easy access guide 58 extends, as set forth above, between the feed assembly 18 and the strapping head 20. In that this portion of the feed path extends between the two modular components, it is fixedly mounted to the frame 12. However, this guide 58 is positioned in a region of the strapping machine 10 that is readily accessible even with the feed assembly 18 in place. In this manner, the path itself is readily accessibly to perform maintenance or, for example, to dislodge debris or jammed strap material S.

Additionally, the guide 58 is configured so that it is easily opened or uncovered to permit ready access to the strap path. The guide 58 includes, as provided above, a fixed portion 126 that extends between the feed assembly 18 discharge and the entrance of the strapping head 20. A cover 128 is mounted to the fixed guide portion 126 that covers the fixed pathway 126. Preferably, the cover 128 is hingedly mounted to the fixed portion 126, by hinges 129 (one shown) so that it is readily pivoted open. In a preferred arrangement, mechanical fasteners 130, such as the hinge-supported fasteners used for the feed guide 114, are disposed on the fixed portion 126, to maintain the cover 128 in place. Thus, to remove the cover 128, it is necessary only to loosen the fasteners 130 (by hand, without the need for tools) and pivot them out of the way. The cover 128 can then be pivoted from the fixed path portion 126 (again, by hand, without the need for tools) to provide access thereto.

Also unlike known strapper path access doors, the present transfer guide cover 128 permits access to the strap across the width of the strap S. Conventional strapping machines include access doors that open to permit access to the strapping material at the thickness (i.e., the gauge measurement dimension) of the strap. Thus, grasping the strap can be a difficult and arduous task. As will be appreciated by those skilled in the art, providing access to the strap S at the width dimension provides a larger area in which to work and greatly facilitates access to debris or pieces of strap material S that may be lodged in the strap path 126.

Figure 5:
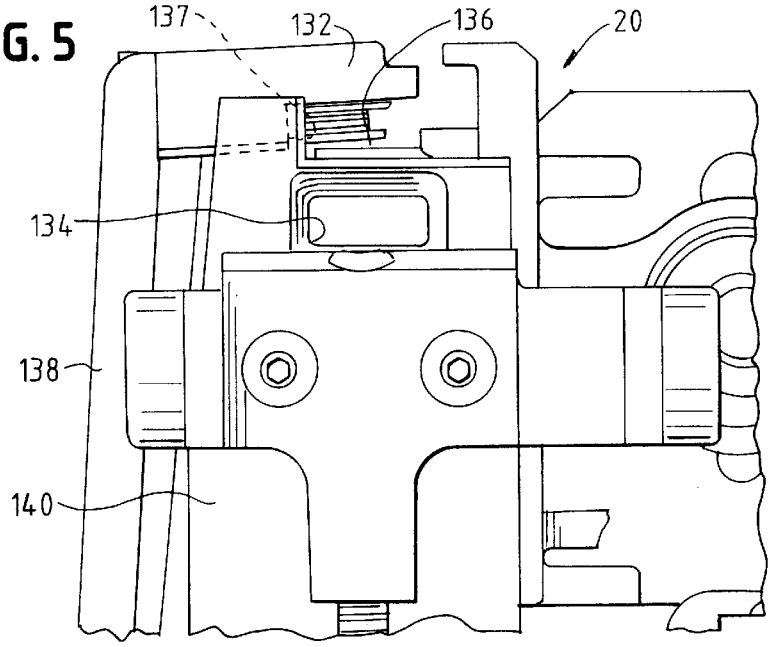
FIG. 5 is a bottom view of the strapping head showing the anvil pivoted outwardly during the feed and retraction modes of operation.
Figure 6:
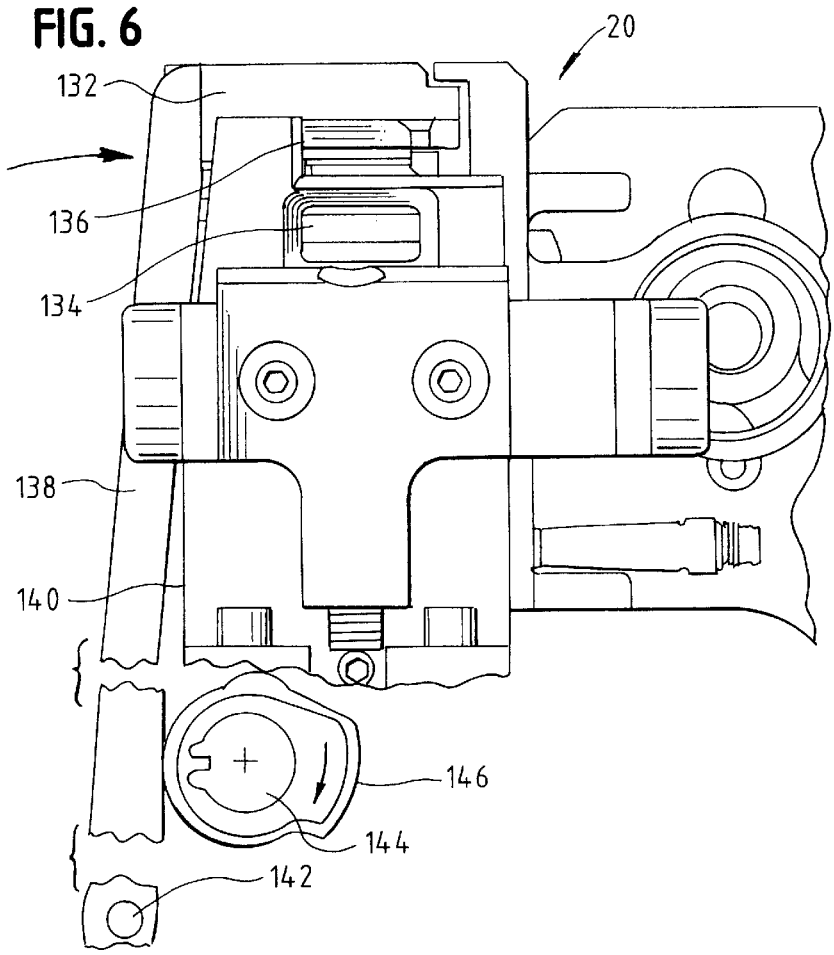
FIG. 6 is a bottom view of the strapping head anvil showing the anvil pivoted inwardly as during the sealing (welding) operation of the strapping head.

Referring now to FIGS. 5–6, the present strapper includes a novel strapping head assembly 20 that utilizes a moving anvil 132. As will be recognized by those skilled in the art, the anvil 132 is that portion of the strapping head 20 against which the strapping material S is pressed during the sealing or welding operation. In order to increase the speed and efficiency of the operation of strappers generally, the strap path at this point is generally narrow and is typically sized only slightly larger than the strap S itself. To this end, known strapping machines include a constriction or throat at about the entrance to the at which debris can collect. Over time, the collection of debris at this area constricts the entrance to the anvil generally resulting in increased strap misfeeds and eventual maintenance of the machines.

The present strapper 10 includes a number of improvements that are directed to minimizing or eliminating this debris collection problem and minimal strap path size problem. Referring to FIGS. 5–6, there is shown a bottom view of the strapping head 20. The head 20 includes two openings for receiving strap S. The first course of strap enters the strapping head 20 through a first opening indicated generally at 134. As the strap S is conveyed through this opening 134, it passes beyond the anvil 132. That is, it traverses through that portion of the head 20 that forms the anvil 132.

The strap S then traverses beyond the head 20, through the chute 16 and around the load L. The strap S is then directed into second opening indicated generally at 136. Once the strap S enters the second opening 136, it is grasped at the free end by the gripper 22 and tension is provided by the take-up operation of the feed assembly 18.

The anvil 132 is mounted to the strapping head 20 in a pivoting arrangement. That is, when the strap material S is fed through the strapping head 20, the anvil 132 pivots outwardly, away from the strap path to enlarge the size of the opening 136 through which the strap material S traverses. In this manner, an increased area is provided for the material S to move through the strapping head 20. Specifically, the width dimension w of the path is increased, as is, consequently, the height h dimension. Once the material traverses through the chute 16 and back up through the gripper opening 136, the anvil 132 then pivots back into place. A guide edge 137 of the anvil 132 urges the strap material S into place (to overlie the prior course of strap S) and the strap S is sealed to itself.

This novel pivoting anvil 132 arrangement provides a number of advantages over fixed anvils. First, as set forth above, it increases the area of the opening 136 through which the strap material S traverses, thus, reducing the possibility for misfeeds. Second, the pivoting anvil 132 moves the strap material S into position so that the first and second courses of strap materials overlie one another for sealing or welding. This increases the assurance that the first and second courses of strap material S will overlie one another without misalignment, to provide optimum strap seal strength.

In a current embodiment, the anvil 132 is fixedly mounted to a side plate 138 of the strapping head 20. The side plate 138 is pivotally mounted to the strapping head body 140 by a pivoting arrangement, such as the exemplary pivot pin 142. The plate 138 is biased toward the body 140. A cam 144 is positioned within the strapping head body 140 and cooperates with the side plate 138. During the feed cycle, the cam 144 rotates and a lobe 146 on the cam contacts the side plate 138, urging the side plate 138 away from the body 140. This, in turn, pivots the anvil 132 away from the body 140, thus enlarging the opening 136. During the gripping, takeup and sealing (e.g., welding) cycles, the cam shaft 144 further rotates such that the lobe 146 disengages from the side plate 138, thus, allowing the anvil 132 to pivot back into place. Those skilled in the art will recognized other arrangements by which the pivoting anvil 132 can be provided, which other arrangements are within the scope and spirit of the present invention.

Figure 11:
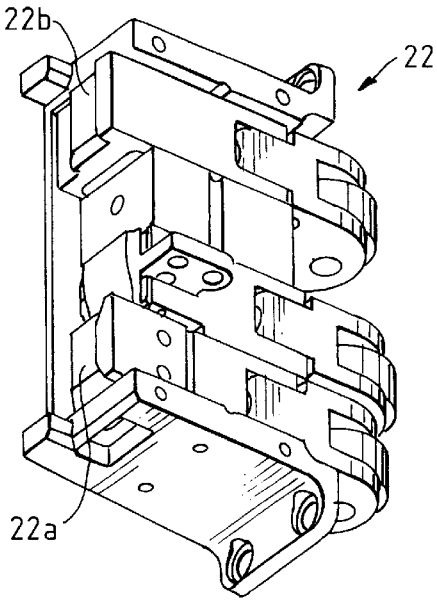
FIG. 11 is a perspective view of the gripper and portions of the gripper path through the strapping head.
Figure 12:
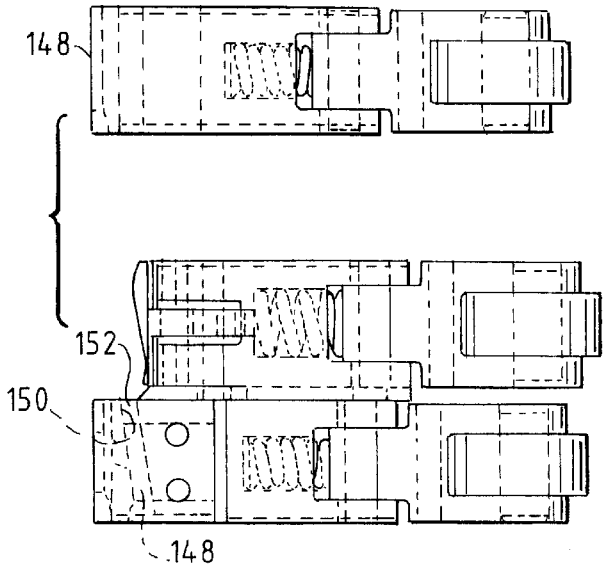
FIG. 12 is a side view of the gripper of FIG. 11.
Figure 13:
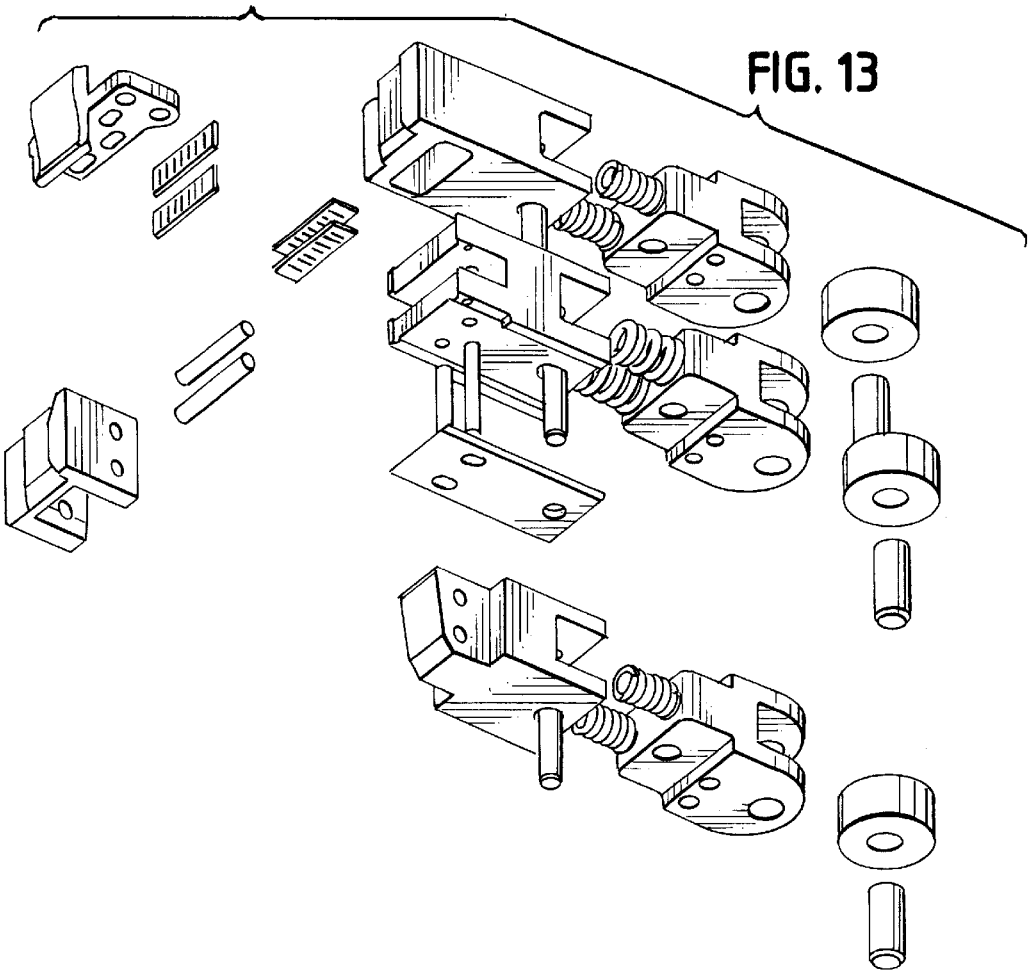
FIG. 13 is an exploded view of the gripper of FIGS. 11 and 12.

In addition to the pivoting anvil 132, as best seen in FIGS. 11–13, the present strapping head 20 includes a novel gripper path indicated generally at 148, through which the first course of material traverses for gripping, prior to tensioning and sealing. Unlike known strappers in which the path tapers downwardly toward the gripper, in the present strapper 10, the strap path 148 is formed from parallel walls 150, 152 that provide a constant path width through the path 148 toward the gripper 22. Although conventional design teaches away from such a constant cross-sectional path, it has been found that the benefits achieved by this path 148 configuration, that is less opportunity for debris collection and malfunction, far outweigh any of the disadvantages.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping machine for positioning a strapping material around an associated load and sealing the strapping material to itself around the load, the strapping machine comprising:

a frame;

a chute defining a strap path, the chute being mounted to the frame;

a feed assembly mounted to the frame, the feed assembly configured to feed the strapping material therethrough;

a strapping head mounted to the frame independent of the feed assembly, the strapping head providing a conveyance path therethrough for feeding the strapping material into the chute and for sealing the strapping material to itself; and a transfer guide mounted to the frame between the feed assembly and the strapping head, the transfer guide including a fixed portion and a removable portion, the fixed portion being fixedly mounted to the frame independent of the feed assembly and the strapping head, the guide configured to receive the strapping material from the feed assembly and to provide a path for the strapping material toward the strapping head, the strap material defining a transfer plane along a longitudinal axis and a width of the strapping material, the removable portion overlying the fixed portion along a plane substantially parallel to the transfer plane.

2. The strapping machine in accordance with claim 1 wherein the removable portion is removably mounted to the fixed portion by at least one mechanical fastener.

3. The strapping machine in accordance with claim 2 wherein the mechanical fastener includes a hinge-supported portion, and wherein when the fastener is loosened from the removable portion the hinge-supported portion retains the fastener mounted to the fixed portion.

4. The strapping machine in accordance with claim 3 including a plurality of fasteners having hinge-supported portions.

5. The strapping machine in accordance with claim 2 wherein the at least one mechanical fastener is knurled.

6. A strapping machine for positioning a strapping material around an associated load and sealing the strapping material to itself around the load, the strapping material defining a feed plane along a longitudinal axis and a width of the strapping material, the strapping material the strapping machine comprising:

a frame;

a chute defining a strap path, the chute being mounted to the frame;

a feed assembly mounted to the frame, the feed assembly configured to receive the strapping material from a source and to feed the strapping material therethrough, the feed assembly including a drive and a pair of feed wheels defining a nip at about an infeed of the pair of feed wheels;

a strapping head mounted to the frame independent of the feed assembly, the strapping head providing a conveyance path therethrough for receiving the strapping material from the feed assembly and feeding the strapping material into the chute; and a removable feed guide including a cover for covering at least a portion of the feed assembly and an arcuate guide wall transverse to the cover generally parallel to the strapping material feed plane, wherein the guide wall is spaced from a periphery of one of the feed wheels at about an entry of the strapping material into the feed guide and wherein the guide wall converges toward a periphery of the one of the feed wheels as the guide wall approaches the nip.

7. The strapping machine in accordance with claim 6 wherein the cover is removably mounted to the feed assembly by at least one mechanical fastener.

8. The strapping machine in accordance with claim 7 wherein the mechanical fastener includes a hinge-supported portion, and wherein when the fasteners is loosened from the cover portion the hinge-supported portion retains the fastener mounted to the fixed portion.

9. The strapping machine in accordance with claim 8 including a plurality of fasteners having hinge-supported portions.

10. The strapping machine in accordance with claim 7 wherein the at least one mechanical fastener is knurled.

* * * * *